US006488546B2

(12) United States Patent
Sakurai et al.

(10) Patent No.: US 6,488,546 B2
(45) Date of Patent: Dec. 3, 2002

(54) CONNECTOR

(75) Inventors: Toshikazu Sakurai, Yokkaichi (JP); Shinya Fujita, Yokkaichi (JP); Hideki Kano, Wako (JP)

(73) Assignees: Sumitomo Wiring Systems, Ltd., Mie (JP); Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/978,558

(22) Filed: Oct. 18, 2001

(65) Prior Publication Data

US 2002/0052152 A1 May 2, 2002

(30) Foreign Application Priority Data

Oct. 27, 2000 (JP) ..... 2000-328985

(51) Int. Cl.[7] ..... H01R 13/502
(52) U.S. Cl. ..... 439/701; 439/717
(58) Field of Search ..... 439/701, 717, 439/594

(56) References Cited

U.S. PATENT DOCUMENTS 5,037,330 A * 8/1991 Fulponi et al. ..... 439/541.5
5,201,674 A * 4/1993 Okura ..... 439/594
5,288,250 A * 2/1994 Sumida ..... 439/701
5,895,296 A * 4/1999 Okabe ..... 439/701
5,904,598 A * 5/1999 Yamanashi ..... 439/354
5,934,944 A * 8/1999 Aoyama et al. ..... 439/701
5,975,961 A * 11/1999 Atsumi et al. ..... 439/701
5,984,732 A * 11/1999 Mehring ..... 439/701
6,196,882 B1 * 3/2001 Sato et al. ..... 174/50
6,264,501 B1 * 7/2001 Hung et al. ..... 439/541.5
6,332,813 B1 * 12/2001 Okabe et al. ..... 439/541.5
6,336,831 B1 * 1/2002 Abe ..... 439/701
6,340,316 B2 * 1/2002 Nagai ..... 439/701
6,343,950 B1 * 2/2002 Eginton et al. ..... 439/157

FOREIGN PATENT DOCUMENTS

JP A 4-39822 2/1992

* cited by examiner

*Primary Examiner*—Tho D. Ta
*Assistant Examiner*—Edwin A. León
(74) *Attorney, Agent, or Firm*—Oliff & Berridge, PLC

(57) ABSTRACT

In block connectors, a male block connector 10 includes male units 11 stacked together in four rows, and six cavities 15, where male metal terminals 2 are received, are formed in each the male units, and are arranged horizontally. Two adjacent male units are combined by a dovetail groove 18 and a dovetail projection 19 provided at these male units. A female block connector 30 includes six female units 31 stacked together horizontally, and four cavities 35, where female metal terminals 5 are received are formed in each of the female units, and are arranged vertically. Two adjacent female units are combined together by retaining plates 39, formed on upper and lower surfaces, and retaining projections 38 formed on the upper and lower surfaces t. Four female metal terminals 5, received in one female unit 31, are connected to male metal terminals 2 received in the male units 11.

6 Claims, 11 Drawing Sheets

CONNECTOR

BACKGROUND OF THE INVENTION

1. Field of the Invention

This invention relates to a connector of the type in which block connectors are fitted together.

2. Description of the Related Art

Recently, in wire harnesses for an automobile, there is a tendency for such a wire harness to be divided so as to be easily handled since circuits have increased in number, and have become complicated. For example, a wire harness is divided into a plurality of sub-harnesses corresponding respectively to associated devices, and these sub-harnesses are produced at separate places, respectively, and thereafter are brought into a predetermined assemblage site where this wire harness is connected to a mating wire harness which is similarly divided into a plurality of sub-harnesses. In such a case, block connectors are used.

This will be schematically shown in FIG. 14A. One wire harness WH1 is divided into two sub-harnesses SH1 and SH2 each having three poles, and the three poles (metal terminals) of each of the sub-harnesses SH1 and SH2 are received collectively in a corresponding connector unit C1, C2, and the two connector units C1 and C2 are assembled together at an assemblage site to form, for example, a male block connector MCB of an integrated construction.

Similarly, a mating wire harness WH2A is divided into two sub-harnesses SH3 and SH4 each having three poles, and connector units C3 and C4, each having the three poles received therein, are assembled together to form a female block connector FCB of an integrated construction. Finally, the male and female block connectors MCB and FCB are fitted together.

In the above construction, the sub-harnesses SH can be produced separately from each other, with the metal terminals received in the connector unit C, and therefore the metal terminals are protected from deformation and so on before the sub-harnesses are brought into the assemblage site. With respect to the fitting connection of the connectors, the block connectors MCB and FCB, each assembled into an integrated construction, are fitted together, and therefore there is obtained an advantage that the fitting operation need only to be effected only once easily.

Depending on a circuit design, there is, as shown in FIG. 14B, the case where a mating wire harness WH2B is divided into three sub-harnesses SH3B, SH4B and SH5B each having two poles, and the tree poles of each of the sub-harnesses SH1 and SH2 of the wire harness WH1 are connected respectively to the poles of the mating sub-harnesses SH3B, SH4B and SH5B in a divided manner. In this case, when the sub-harnesses SH3B, SH4B and SH5B are produced separately from one another, the two metal terminals of each of the sub-harnesses SH3B, SH4B and SH5B can not be received in the same connector unit, and therefore if it is desired to avoid bringing these sub-harnesses, with their metal terminals kept exposed, in order to protect these metal terminals, the metal terminals need to be received in connector units C5, respectively. As a result, there have been encountered problems that the number of the connector units increases, and that more time and labor are required for fitting the connector units together at the assemblage site.

SUMMARY OF THE INVENTION

This invention has been achieved under the above circumstances, and an object of the invention is to provide block connectors which can be used for making connection between sub-harnesses, for example, of a pair of wire harnesses in an intricate manner when the pair of wire harnesses are connected together.

According to the present invention, there is provided a connector wherein a pair of block connectors, each comprising a plurality of connector units combined together, are fitted together; wherein one of the block connectors comprises the connector units stacked one upon another in a plurality of rows, each of the connector units having a plurality of cavities arranged in a horizontal direction; and wherein the other block connector comprises the connector units which are equal in number to the cavities in each connector unit of the one block connector, and are combined together in the horizontal direction, each of the connector units of the other block connector having a plurality of cavities which are equal in number to the rows of stacked connector units of the one block connector, and are arranged in a vertical direction.

In the invention, the direction of combining of the connector units in the block connector is perpendicular to the direction of fitting of the block connector relative to the mating block connector.

This invention is based on the idea that the direction of arrangement of the connector units of the male block connector is shifted 90 degrees (between the vertical and horizontal directions) from the direction of arrangement of the connector units of the female block connector. For example, in the case where n connector units (each having m poles arranged in the horizontal direction) of one of the male and female block connectors are combined together in the vertical direction, m connector units (each having n poles arranged in the vertical direction) of the other block connector are combined together in the horizontal direction.

For example, one of a pair of wire harnesses is divided into n sub-harnesses, and m poles, provided at each of these sub-harness, are received in the same connector unit. The other wire harness is divided into m sub-harnesses, and n poles, provided at each of these sub-harnesses, are received in the same connector unit. In this case, when the two block connectors are fitted together, (n) poles of one sub-harness of the other wire harness can be connected in an assigned manner respectively to (n) poles provided respectively at the sub-harnesses of the one wire harness.

Thus, the block connectors of the invention can be used for making connection between the sub-harnesses of the pair of wire harnesses in an intricate manner when the pair of wire harnesses are connected together, and the number of the connectors can be prevented from increasing, and besides the operation for fitting the connectors together can be easily effected.

Also, the direction of combining of the connector units is perpendicular to the direction of fitting of the block connector relative to the mating block connector. Therefore, even if a resistance is offered during the fitting of the two block connectors, the connector units, combined together, are prevented from being disconnected from each other.

DETAILED DESCRIPTION OF THE PREFERRED EMBODIMENTS

One preferred embodiment of the present invention will now be described with reference to FIGS. 1 to 13.

Figure 5:
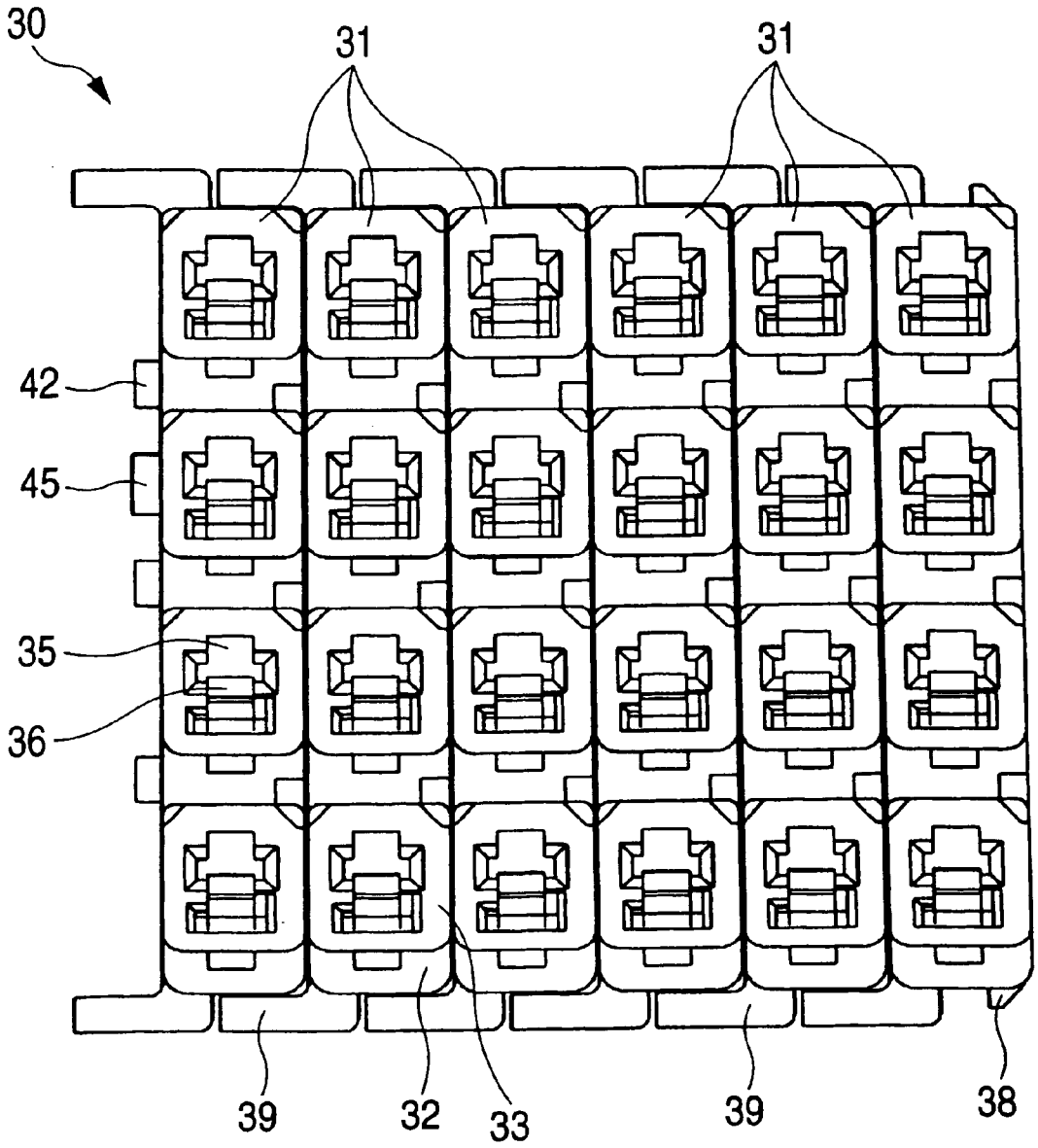
FIG. 5 is a front-elevational view of a female block connector.

In this embodiment, there are provided a pair of male block connector 10 (see FIG. 1) and female block connector 30 (see FIG. 5).

Figure 1:
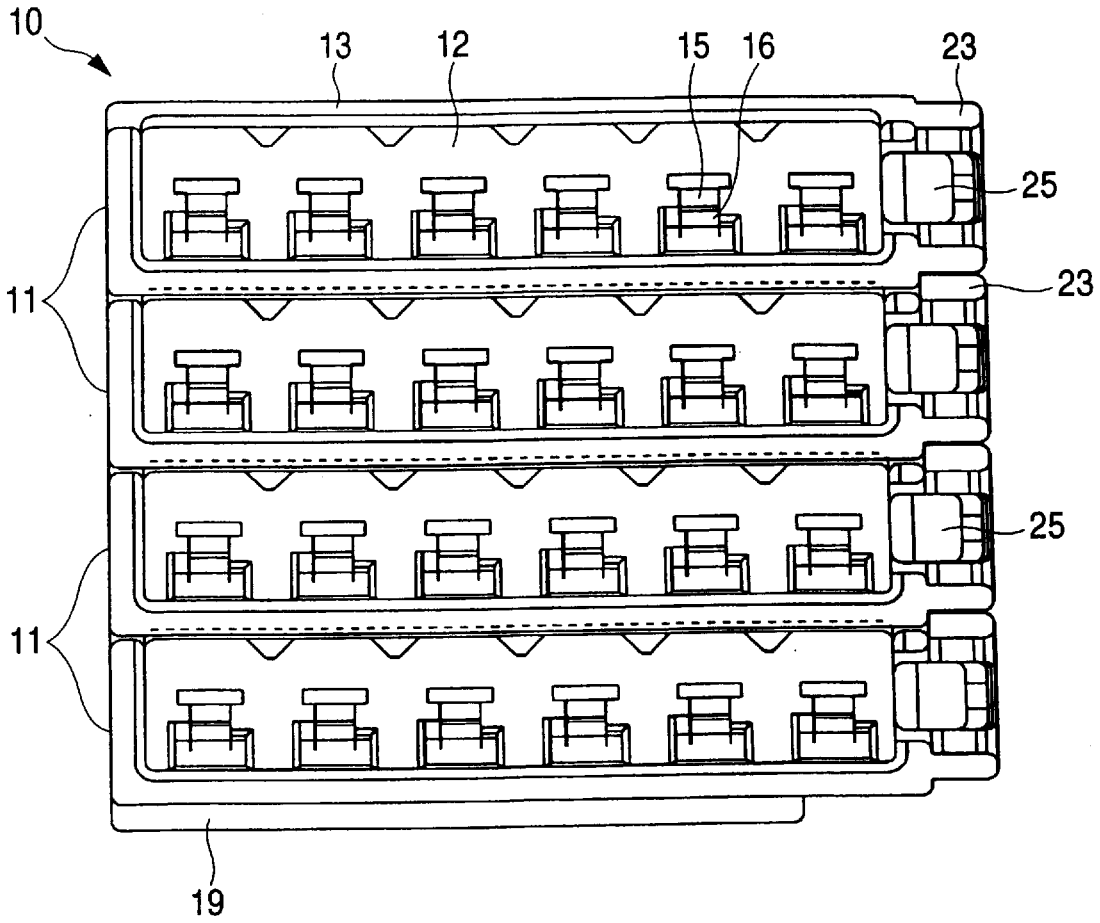
FIG. 1 is a front-elevational view of one preferred embodiment of a male block connector of the present invention.

The block connectors 10 and 30 will be described in detail. As shown in FIG. 1, the male block connector 10 comprises four male connector units 11 (hereinafter referred to as "male units"). The male units 11 are made of a synthetic resin, and have the same configuration.

Figure 2:
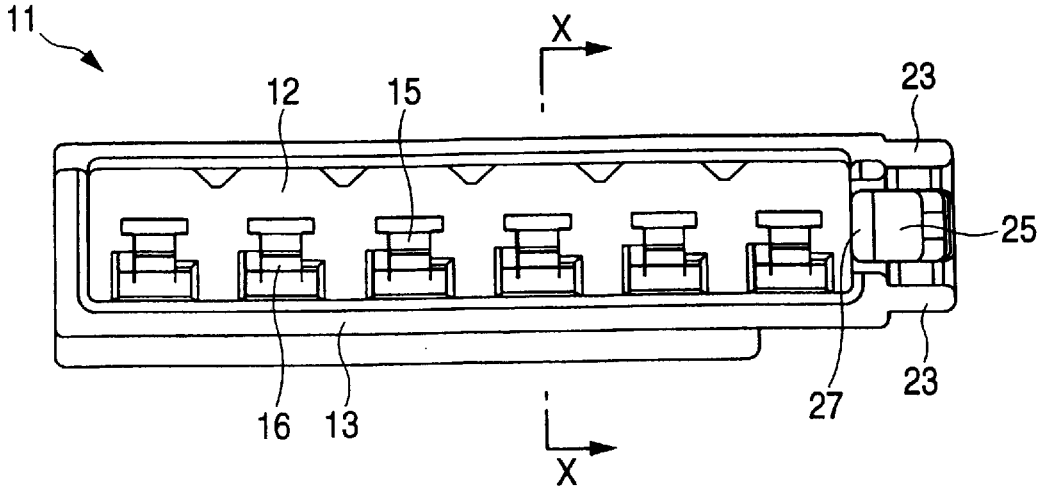
FIG. 2 is a front-elevational view of a male unit.
Figure 3:
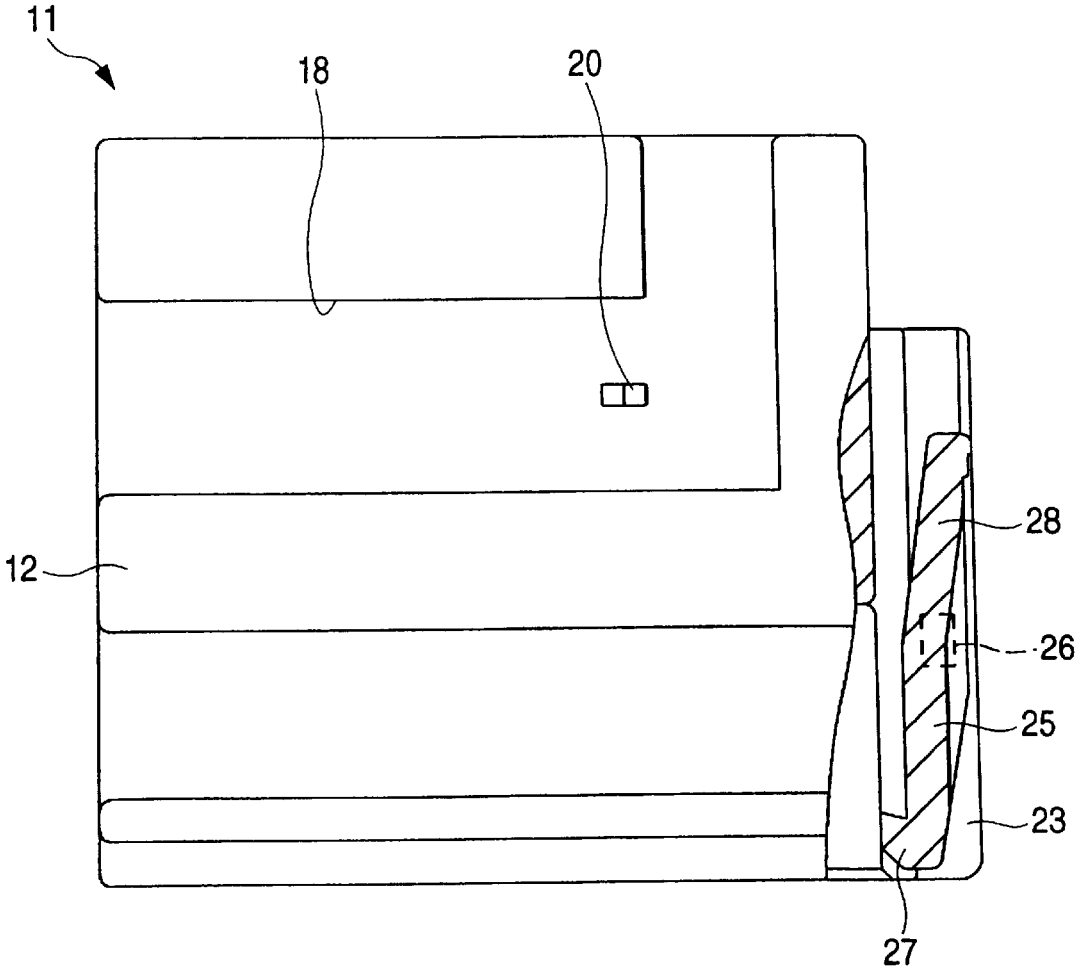
FIG. 3 is a partly-broken, plan view of the male unit.
Figure 4:
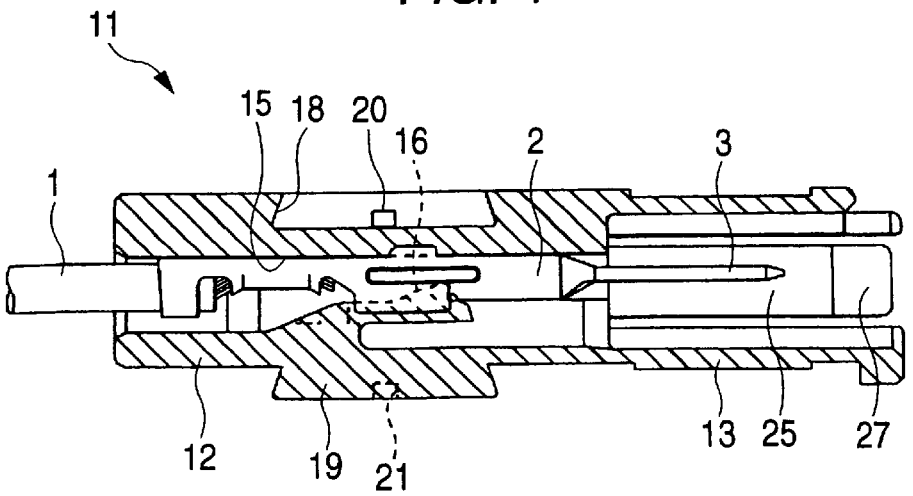
FIG. 4 is a cross-sectional view taken along the line X—X of FIG. 2.

The male unit 11 has the configuration shown in FIGS. 2 to 4, and has a hood portion 13 formed on and projecting from a front side of a flattened base portion 12 of a large transverse dimension. Six cavities 15 are formed in the base portion 12, and are spaced at predetermined intervals in the transverse (horizontal) direction. A male metal terminal 2, fixedly secured to an end of a wire 1, is inserted into each cavity 15 from a rear side (left side in FIG. 4) thereof, and is retained by a lance 16, formed on a bottom surface of the cavity 15, and therefore is received in the cavity against withdrawal, with its tab 3 projecting into the interior of the hood portion 3.

As shown in FIG. 3, a dovetail groove 18 is formed in an upper surface of the base portion 12 of the male unit 11, and extends from a left side edge thereof to a position spaced slightly from a right side edge thereof, and this dovetail groove has an open left end and a closed right end. A dovetail projection 19 for snugly fitting in the dovetail groove 18 is formed on a lower surface of the base portion 12, and extends from the left side edge thereof to a position spaced slightly from the right side edge thereof. An engagement projection 20 is formed on a bottom surface of the dovetail groove 18 at a right end portion thereof. An engagement recess 21 for fitting on the engagement projection 20 is formed in that portion of the surface of the dovetail projection 19 corresponding to the engagement projection 20. A left-hand surface (FIG. 3) of the engagement projection 20 is formed into a tapering (slanting) surface.

A pair of upper and lower protective walls 23 are formed on a right side surface (when viewed from the front side) of the male unit 11, and extend from the front side thereof to a position slightly spaced from the rear side thereof. A lock arm 25 is provided between the pair of protective walls, and extends in a forward-rearward direction. This lock arm 25 can be swayed about a fulcrum 26 provided at a lengthwise central portion thereof. A hook 27 is formed at a distal end of this lock arm 25, and a cancellation portion 28 for forcibly elastically deforming the lock arm 25 so as to cancel its locked condition is formed at a rear end of the lock arm 25.

On the other hand, the female block connector 30 comprises six female connector units 31 (hereinafter referred to as "female units"). The female units 31 are also made of a synthetic resin, and have the same configuration.

Figure 6:
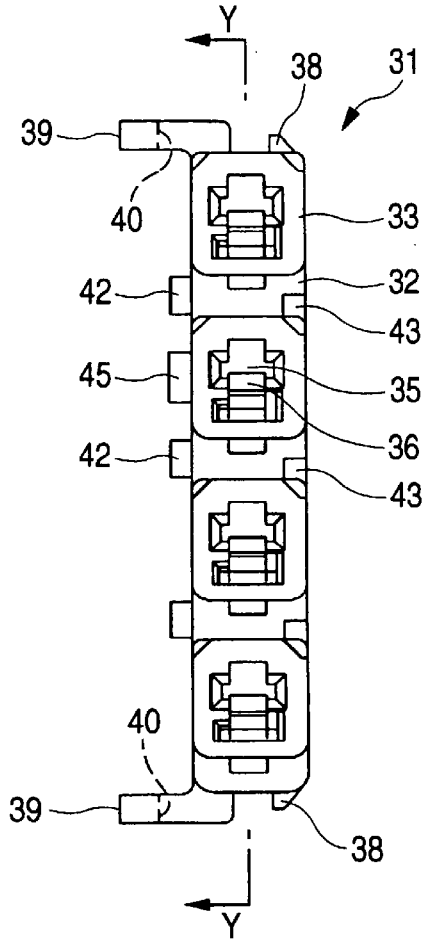
FIG. 6 is a front-elevational view of a female unit.
Figure 7:
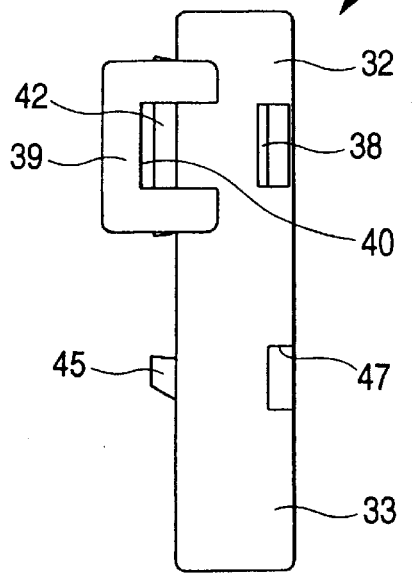
FIG. 7 is a plan view of the female unit.
Figure 8:
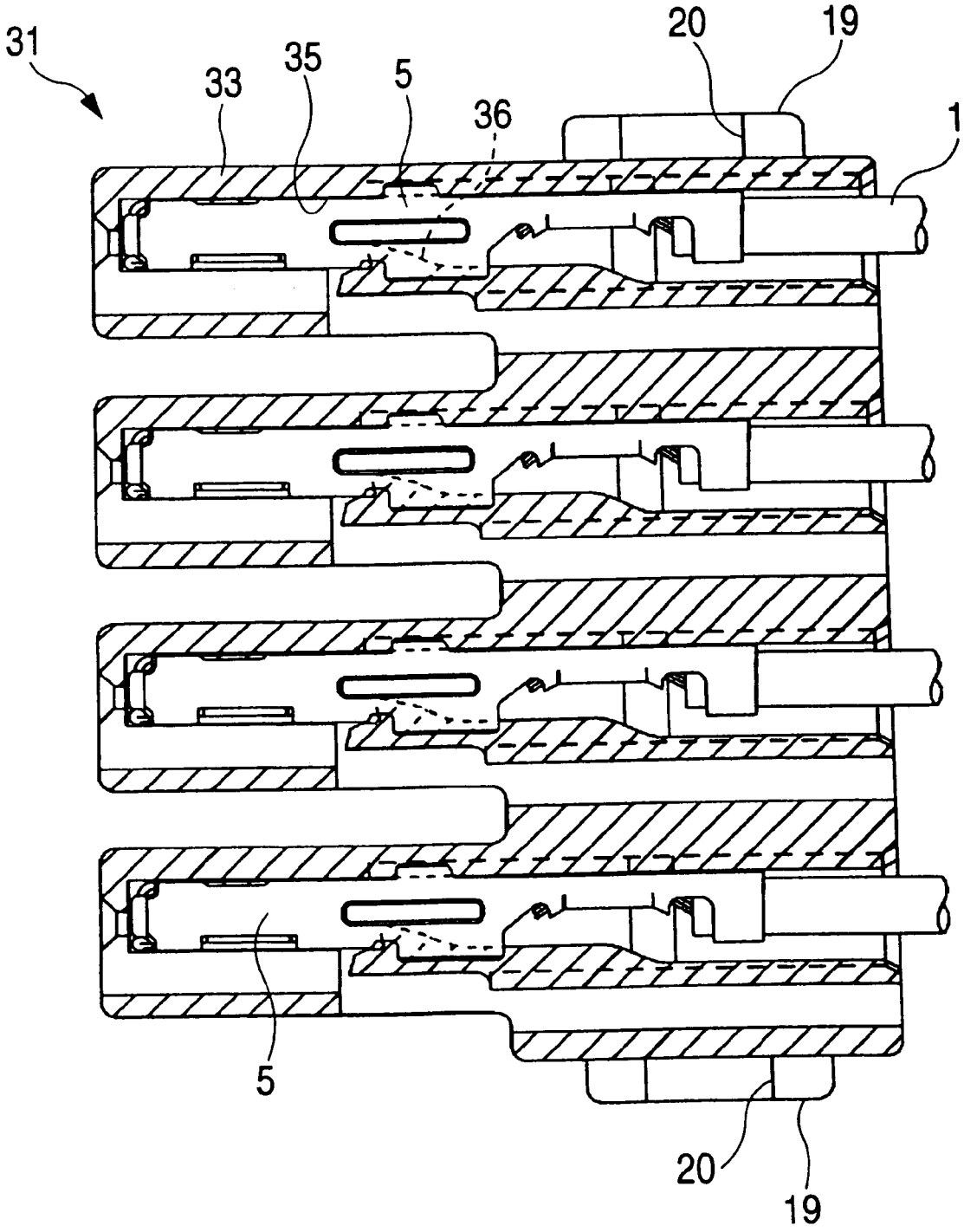
FIG. 8 is a cross-sectional view taken along the line Y—Y of FIG. 6.

As shown in FIGS. 6 to 8, the female unit 31 has four reception projections 33 formed on and projecting from a front side of a flattened base portion 32 of a large vertical dimension, the reception projections 33 being juxtaposed at predetermined intervals in the vertical direction. The female unit 31 has a vertical dimension equal to the height of the assembled male block connector 10, and has a transverse (horizontal) dimension corresponding to the pitch of the cavities 15 in the male unit 11.

A cavity 35 is formed in each reception projection 33, and is open to a rear surface of the base portion 32. A female metal terminal 5, fixedly secured to an end of a wire 1, is inserted into each cavity 35 from the rear side (right side in FIG. 8) thereof, and is retained by a lance 36, formed on a bottom surface of the cavity 35, and therefore is received in the cavity against withdrawal.

The pitch of the cavities 35 (formed in the female unit 31) in the upward-downward direction (vertical direction) is equal to the pitch of the cavities 15 of the vertically-adjoining male units 11 of the assembled male block connector 10.

On the other hand, the pitch of the cavities 15 of the male unit 11 is equal to the pitch of the cavities 35 of the horizontally-adjoining female units 31 of the assembled female block connector 30. Each row of six reception projections 33 of the horizontally-adjoining female units 31 of the assembled female block connector 30 can be fitted collectively in the hood portion 13 of the corresponding male unit 11.

Retaining projections 38 are formed respectively on upper and lower surfaces of the base portion 32 of the female unit 31 at their respective right edge portions (when viewed from the front side thereof). As shown in FIG. 6, the retaining projection 38 has a vertical left side surface serving as a retaining surface, while a right side surface thereof is tapering (slanting), and serves as a guide surface. Retaining plates 39 are formed respectively on the upper and lower surfaces of the base portion 32 at their respective left edge portions, and extend in a left-hand direction, and each of the retaining projection 38.

Ribs 42 are formed on the left side surface of the base portion 32, the rib 42 being provided between any two adjacent cavities 35. Fitting grooves 43 are formed in the right side surface of the base portion 32, and these fitting grooves 43 are fitted respectively on the corresponding rib 42 so as to effect the positioning mainly in the forward-rearward direction.

A lock projection 45, which is engageable with the hook 27 of the lock arm 25, is formed on the left side surface (when viewed from the front side) of the second reception projection 33 (counting from the top) of the female unit 31. As shown in FIG. 7, the lock projection 45 has a vertical rear surface and an upwardly-slanting front surface. An escape recess 47 for receiving the lock projection 45 is formed in the right side surface of the second reception projection 33 (counting from the top).

Next, the assembling procedure for this embodiment will be described.

A male-side wire harness is divided into four sub-harnesses, and six male metal terminals 2 are connected to an end of each of these sub-harnesses. The six male metal terminals 2 of each sub-harness are inserted and received respectively in the cavities 15 in the same (one) male unit 11.

A female-side wire harness is divided into six sub-harnesses, and four female metal terminals 5 are connected to an end of each of these sub-harnesses. The four female metal terminals 5 of each sub-harness are inserted and received respectively in the cavities 35 in the same (one) female unit 31.

Figure 9:
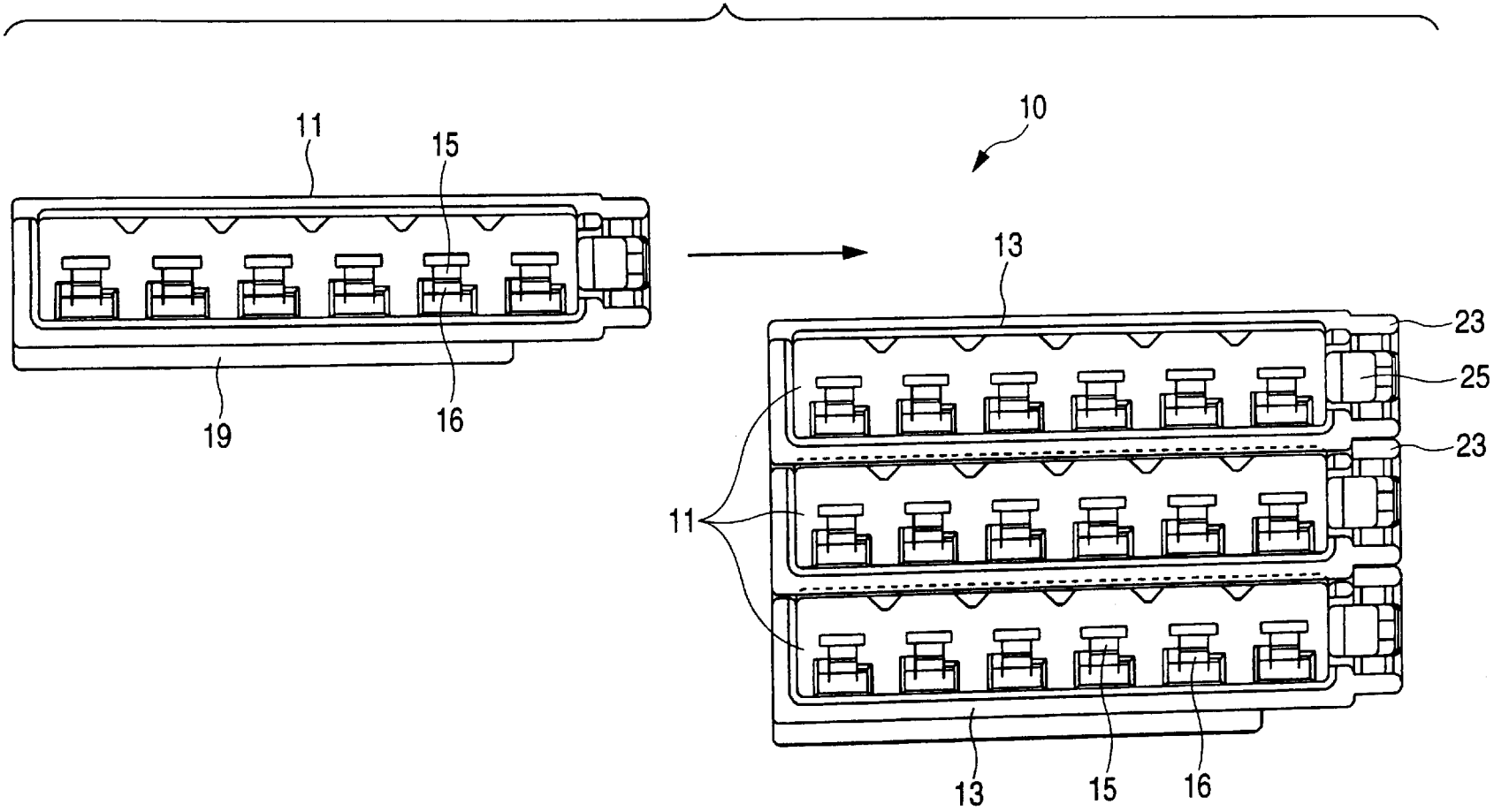
FIG. 9 is a front-elevational view explanatory of an assembling operation of the male block connector.

For assembling the male block connector 10, the male units 11 are stacked one upon another in four rows as shown in FIG. 9. More specifically, the dovetail projection 19, formed on the lower surface of the upper male unit 11, is disposed in registry with the dovetail groove 18, formed in the upper surface of the lower male unit 11, and in this condition the upper male unit is pushed in a right-hand direction as indicated by an arrow. When the upper male unit is thus pushed into a proper position where the right and left side surfaces of the upper male unit 11 are flush with the right and left side surfaces of the lower male unit 11, respectively, the engagement projection 20, formed at the dovetail groove 18, is fitted in the engagement recess 21 formed in the dovetail projection 19, so that the upper and lower male units 11 are combined together.

Then, the same procedure is repeated, thereby forming the male block connector 10 comprising the four male units 11 combined together in a vertical-stacked manner, as shown in FIG. 1.

Figure 10:
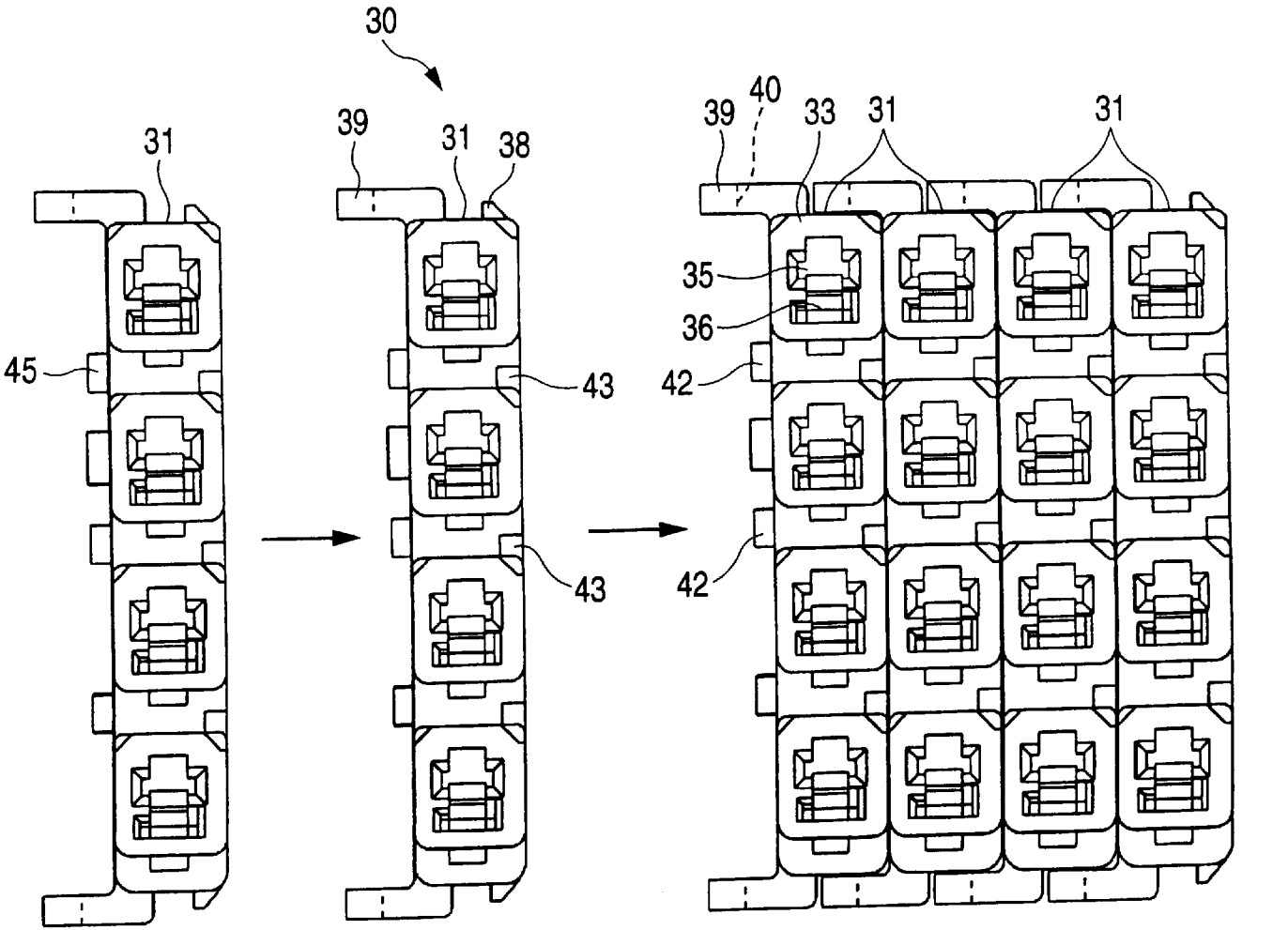
FIG. 10 is a front-elevational view explanatory of an assembling operation of the female block connector.

For assembling the female block connector 30, the female units 31 are combined together in six columns sequentially from the right as shown in FIG. 10. More specifically, the fitting grooves 43 in the left female unit 31 are disposed in the registry with the ribs 42 on the right female unit 31 is pushed, the retaining plates 39 of the right female unit 31 are elastically deformed, and slide respectively on the retaining projections 38 of the left female unit 31. When the left female unit 31 is pushed until the right and left female units 31 are stacked together, each of the retaining plates 39 is restored into its initial shape, and therefore the retaining projection 38 is fitted in the retaining hole 40, so that the right and left female units 31 are combined together.

Then, the same procedure is repeated, thereby forming the female block connector 30 comprising the six female units 31 combined together in a horizontally-stacked manner as shown in FIG. 5. The lock projection 45 on the right one of any two adjacent female units 31 for escaping purposes (see FIG. 11).

Here, those reception projections 33 of the female units 31 (arranged in six columns), disposed in the same vertical position, are juxtaposed horizontally in a row, and therefore there are provided four rows of reception projections 33 in the vertical direction (upward-downward direction).

Figure 11:
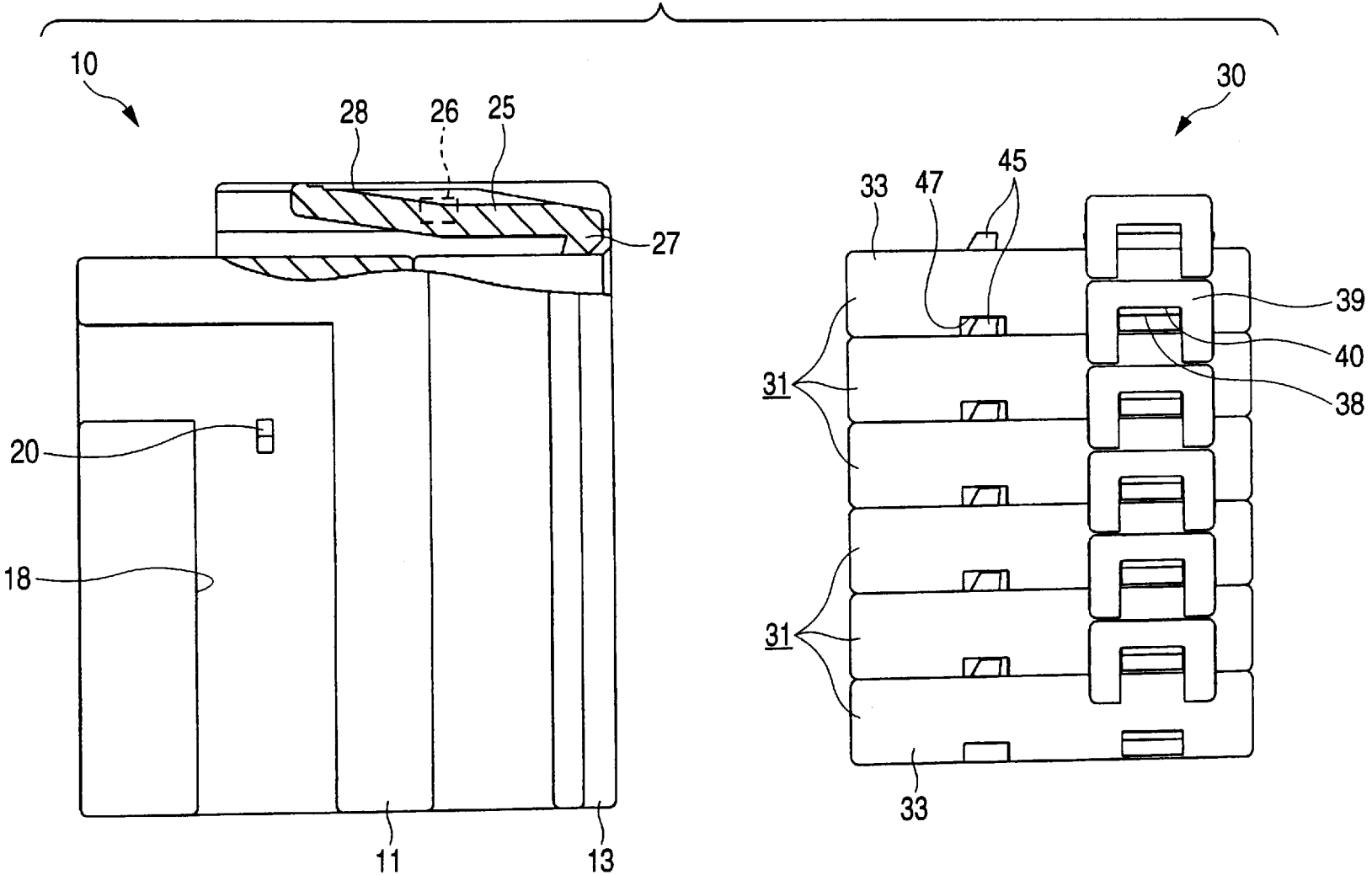
FIG. 11 is a partly-broken, plan view showing a condition before the male and female block connectors are fitted together.
Figure 12:
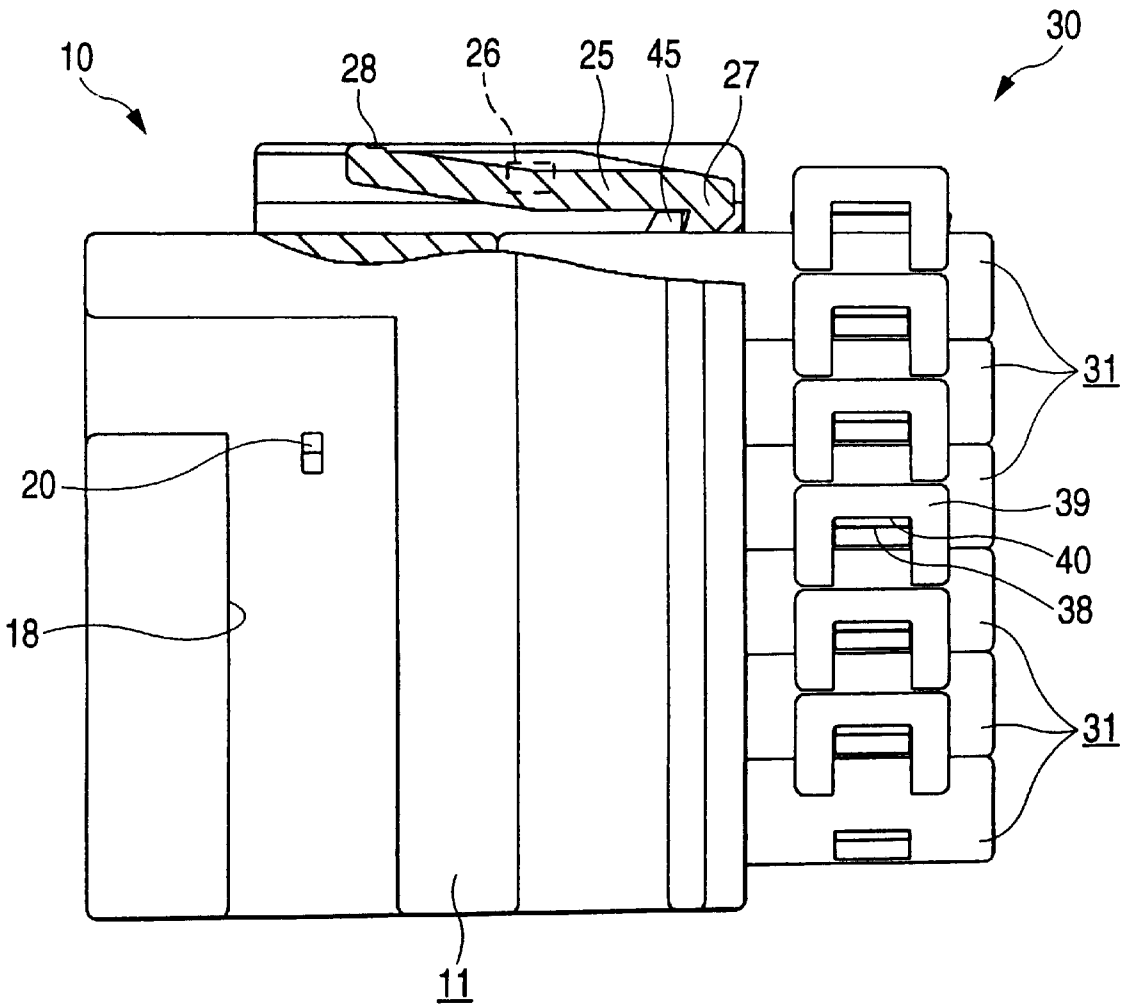
FIG. 12 is a partly-broken, plan view showing a condition after the fitting operation is completed.
Figure 13:
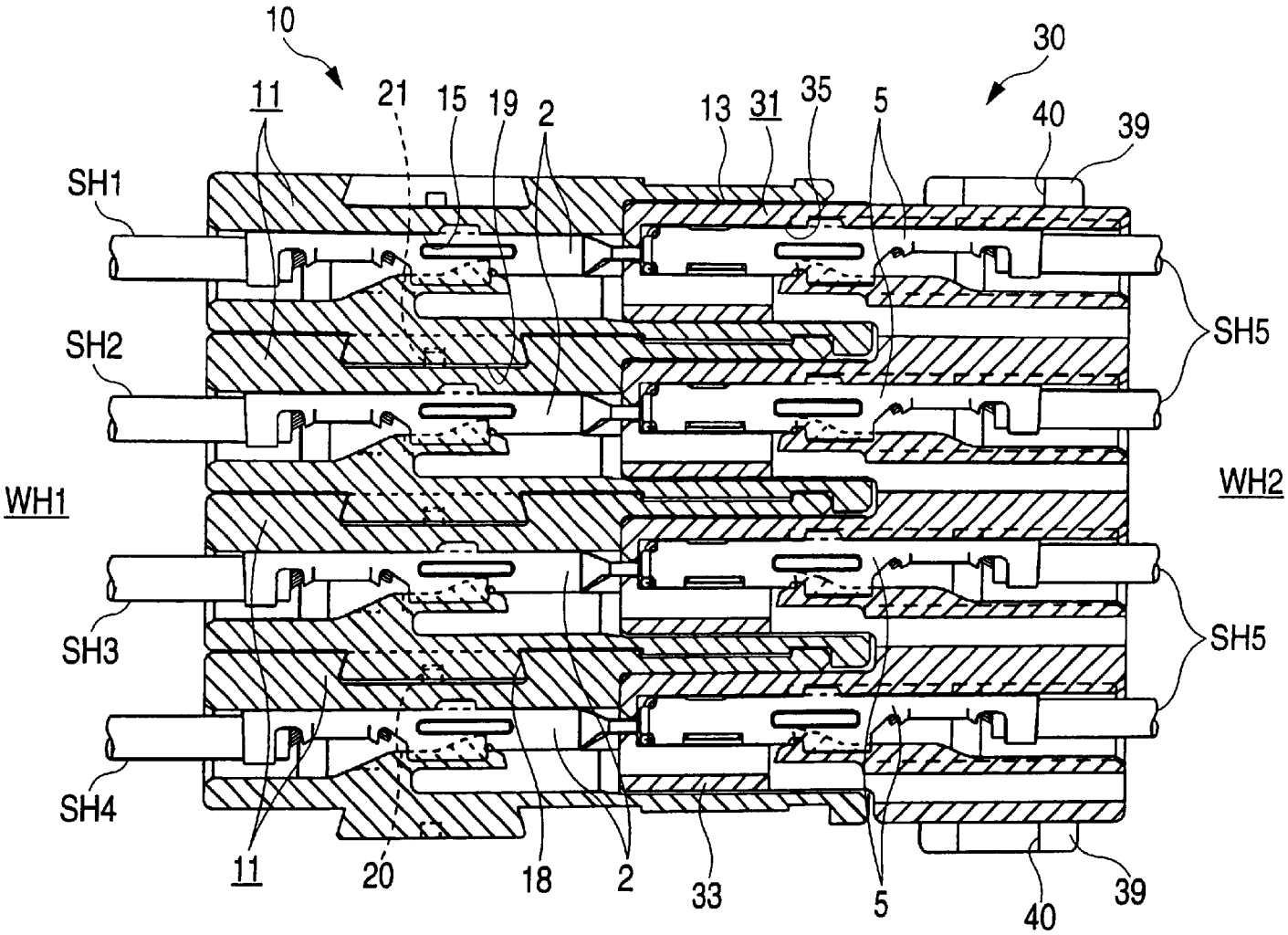
FIG. 13 is a vertical cross-sectional view showing this fitted condition.
Figure 14A:
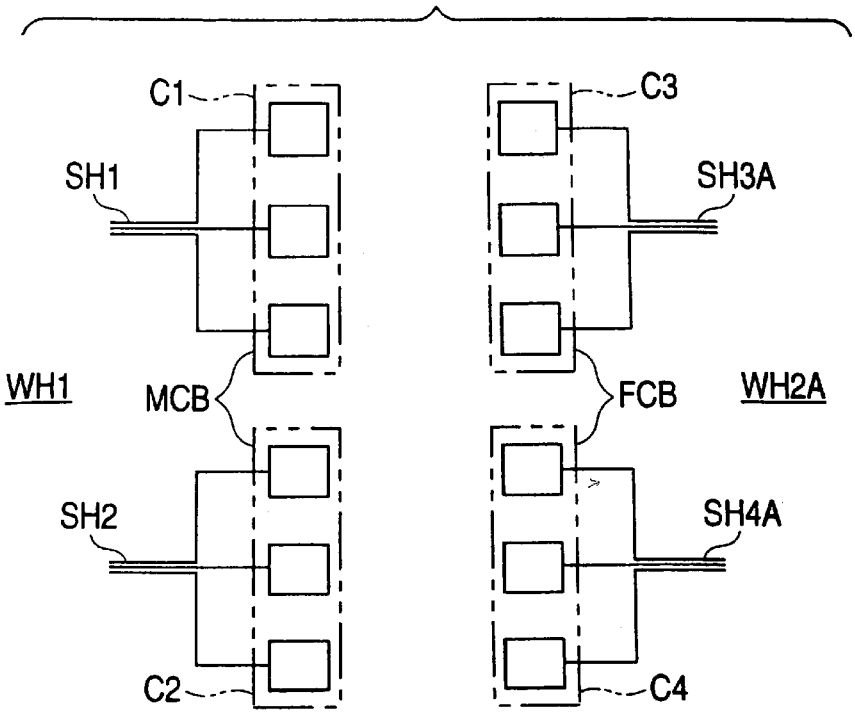
Prior Art FIG. 14A
FIGS. 14A and 14B are schematic views showing wire harness-connecting forms.
Figure 14B:
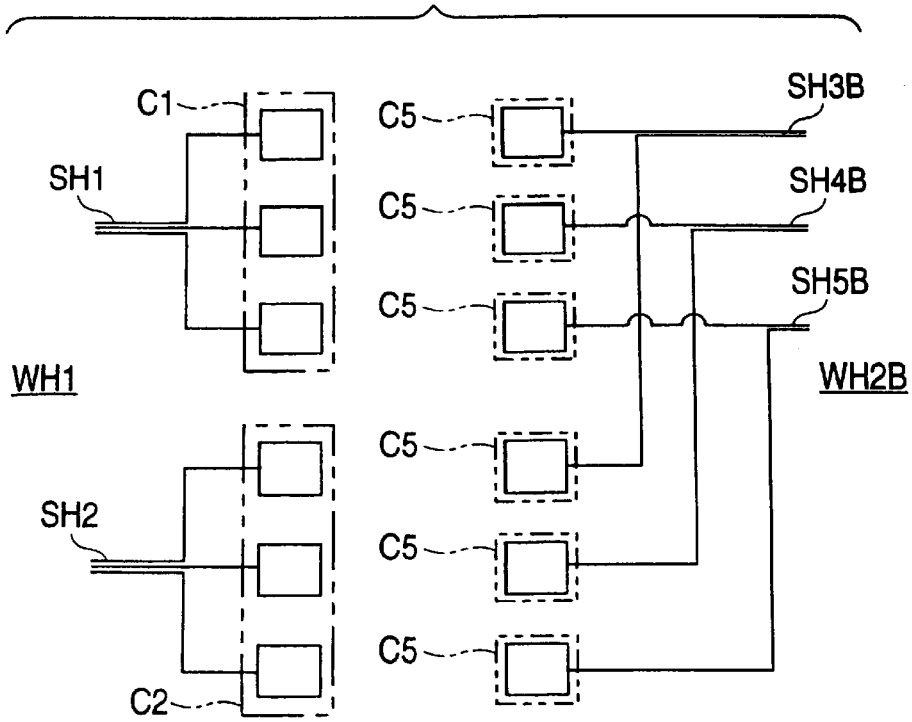
Prior Art FIG. 14B

Then, the male and female block connectors 10 and 30, each thus assembled, are opposed to each other as shown in FIG. 11, are fitted together. In the two block connectors 10 and 30, the four rows of reception projections 33, arranged in the vertical direction, are fitted into the hood portions 13 of the female units 11, respectively, and during this fitting operation, the second lock arm 25, counting from the top, abuts against the corresponding lock projection 45, and is elastically deformed to slide thereon. When the rows of reception projections 33 are inserted a predetermined amount respectively into the hood portions 13 to be properly fitted therein, each mating pair of male and female metal terminals 2 and 5 are properly connected together as shown in FIG. 13. At this time, the distal end of the lock arm 25 passes past the lock projection 45, so that the lock arm 25 is restored into its initial shape, and is retained by the rear surface of the hook 27 as shown in FIG. 12, thereby locking the male and female block connectors 10 and 30 in a properly-fitted condition.

As described above, in this embodiment, one wire harness WH1 is divided into four sub-harnesses SH1 to SH4 as shown in FIG. 13, and six male metal terminals 2, connected to each of these sub-harnesses, are received in the same male unit 11. The other wire harness WH2 is divided into six sub-harnesses, and four female metal terminals 5, connected to each of these sub-harnesses, are received in the same female unit 31. In this case, when the two block connectors 10 and 30 are fitted together, the four female metal terminals 5 of one sub-harness SH5 of the other wire harness WH2 can be connected in an assigned manner respectively to four male metal terminals 2 provided respectively at the four sub-harnesses SH1 to SH4 of the one wire harness WH1.

Namely, the block connectors can be used for making connection between the metal terminals of the sub-harnesses of the pair of wire harnesses in an intricate manner when the pair of wire harnesses are connected together, and the number of the connectors can be prevented from increasing, and besides the operation for fitting the connectors together can be easily effected at one time.

The male unit 11 has a relatively large thickness, and therefore the dovetail groove 18 and the dovetail projection 19 are used as means for combining the male units 11 together. The direction of combining the male units 11 together is perpendicular to the direction of fitting of the male and female block connectors 10 and 30. Therefore, even if a resistance is offered during the fitting of the male and female block connectors 10 and 30, the male units 11, combined together, are prevented from being disconnected from each other.

With respect to the lock mechanism for locking the male and female block connectors 10 and 30 in the fitting condition, the lock arms 25 are formed respectively on all of the male units 11 (the male side) whereas the lock projections 45 are formed respectively on all of the female units 31 (the female side). One of the lock arms and one of the lock projections are used, and the other lock arms are kept in an unused condition, and the other lock projections are received in the respective escape recess 47. Namely, the male units 11 for forming the male block connector 10, as well as the female units 31 for forming the female block connector 30, have the same configuration, and therefore the production cost can be reduced.

The present invention is not limited to the embodiment described above with reference to the drawings, and for example, the following embodiment also falls within the technical scope of the invention, and further various modifications other than the following can be made without departing from the scope of the invention. (1) The number of the poles, provided at the connector units, and the number of the connector units to be combined together, may be other numerical values than those described in the above embodiment. Namely, in the case where n connector units (each having m poles arranged in the horizontal direction) of one of the male and female block connectors are combined together in the vertical direction, m connector units (each having n poles arranged in the vertical direction) of the other block connector are combined together in the horizontal direction. m and n stand for the plural number, and m=n is acceptable.

What is claimed is:

1. A connector comprising:

a pair of block connectors, each including a plurality of connectors units combined together and fitted together;

one of said block connectors comprises the connector units stacked one upon another in a plurality of rows, each of said connector units having a plurality of cavities arranged in a horizontal direction; and the other block connector comprises the connector units which are equal in number to said cavities in each connector unit of said one block connector, and are combined together in the horizontal direction, each of said connector units other block connector having a plurality of cavities which are equal in number of the rows of staked connector units of said one block connector, and are arranged in a vertical direction, wherein the one block connector is electrically combined and fitted to the other block connector in a fitting direction.

2. The connector according to claim 1, wherein the direction of combining of said connector units in said block connector is perpendicular to the fitting direction of the pair of blocks connectors.

3. The connector according to claim 1, wherein one of the pair of block connectors includes a projection that is received into a corresponding cavity of the other block connector.

4. The connector according to claim 1, further comprising a lock arm provided on one of the pair of block connectors that locks onto a corresponding lock projection on the other of the pair of block connectors.

5. The connector according to claim 1, wherein a plurality of female terminals are fitted into the plurality of cavities of one of the pair of block connectors, a plurality of male terminals are fitted into the plurality of cavities of the other one of the pair of block connectors, and the male terminals are capable of being received by the female terminals when the pair of connector blocks are fitted together.

6. The connector according to claim 1, wherein a number of sub-harnesses connected to one of the pair of block connectors is a different quantity than a number of sub-harnesses connected to the other one of the pair of block connectors.

* * * * *